US008534305B1

(12) United States Patent
Woodall et al.

(10) Patent No.: US 8,534,305 B1
(45) Date of Patent: Sep. 17, 2013

(54) REVERSIBLE HEATING/COOLING STRUCTURE USABLE AS A POP-UP SHELTER

(75) Inventors: Robert C. Woodall, Panama City, FL (US); Felipe A. Garcia, Panama City, FL (US); Gregory A. Reitmeyer, Panama City, FL (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 280 days.

(21) Appl. No.: 13/066,854

(22) Filed: Apr. 15, 2011

(51) Int. Cl.
*E04H 15/02* (2006.01)
*E04H 15/10* (2006.01)

(52) U.S. Cl.
USPC ..... 135/96; 135/91; 135/126; 135/116; 135/115; 47/29.5; 52/198

(58) Field of Classification Search
USPC ..... 135/125–126, 135, 137, 116, 115, 135/91–92, 94; 52/83, 198; 47/20.1, 29.5; 126/628
See application file for complete search history.

(56) References Cited

U.S. PATENT DOCUMENTS

| | | | | |
|---|---|---|---|---|
| 2,314,830 | A * | 3/1943 | Hunter | 135/93 |
| 3,598,133 | A * | 8/1971 | Abert et al. | 135/94 |
| 4,531,330 | A * | 7/1985 | Phillips | 52/2.21 |
| 5,502,927 | A * | 4/1996 | Hammerton | 52/218 |
| 5,562,115 | A * | 10/1996 | Sotelo | 135/156 |
| 5,642,750 | A * | 7/1997 | Brown et al. | 135/137 |
| 5,660,197 | A * | 8/1997 | Boe et al. | 135/116 |
| 7,137,399 | B1 * | 11/2006 | Ransom et al. | 135/128 |
| 7,882,849 | B2 * | 2/2011 | Franta | 135/115 |
| 2006/0057918 | A1 * | 3/2006 | Burnett | 442/132 |
| 2008/0289674 | A1 * | 11/2008 | Franta | 135/122 |
| 2010/0059095 | A1 * | 3/2010 | Hinz et al. | 135/120.1 |

* cited by examiner

*Primary Examiner* — Winnie Yip
(74) *Attorney, Agent, or Firm* — James T. Shepherd

(57) ABSTRACT

A structure, e.g. a pop-up tent, usable in extremes of temperature, wind, and aridity. One side of the structure's fabric reflects heat, and the other absorbs heat. The structure is reversible, so that, depending which side is outside and which inside, the structure either rejects or absorbs ambient heat, making the structure cooler in hot environments, and warmer in cool environments. The structure can have a detachable base with a hollow chamber in which one can put thermally insulating fluid (e.g. water) to add further comfort, which also provides additional physical and thermal stability to the structure. An optional moisture collector is disposable inside to collect condensate for recycling, and the fabric of the structure can be hydrophobic to direct other condensate to the base and away from occupants.

19 Claims, 2 Drawing Sheets

REVERSIBLE HEATING/COOLING STRUCTURE USABLE AS A POP-UP SHELTER

STATEMENT OF GOVERNMENT INTEREST

The invention described herein may be manufactured and used by or for the Government of the United States of America for Governmental purposes without the payment of any royalties thereon or therefor.

FIELD OF THE INVENTION

The invention pertains to portable, habitable, structures, in particular tents, and particularly readily portable pop-up tents.

BACKGROUND OF THE INVENTION

Pop-structures are known, and are used to form tents that can be flattened and folded for easy transport, and can readily pop-up into the shape of a tent for ready deployment. However, such tents are not designed for comfort in areas that experience extreme variations in hot, cold, arid, and windy weather. For example, Afghanistan has nearly 300 sunny days per year, maximum temperatures of near 95° F. to lows around 20° F., and winds ranging from a constant 5 to 14 MPH, in a relatively arid climate in which rainfall averages less than 12 inches per year and wind chill can be near zero degrees Fahrenheit. Inexpensive pop-up shelters that can protect and provide comfort to users in such a climate would thus be of value to military troops deployed in such areas, campers and hikers, and even the local indigenous population.

Conventional tents deployed in cold weather tend to form warm vapor on inside tent surfaces, making conditions inside unpleasant, and losing water which, if retrievable, would be a benefit in arid areas. For example, on a typical evening in Afghanistan about one cup of water from exhaled air can condense on a tent wall surface and begin to drip on occupants, which can be a serious problem. In a tent built for two this could result in as much as 16 ounces of water being dripped onto occupants and gear making the environment cold, wet, and uncomfortable.

SUMMARY OF THE INVENTION

Accordingly, an object of the invention is provide a structure useable as a tent that is easily deployable and storable, and that also provides thermal comfort to those within the structure in extremes of hot and cold.

Another object is to prevent water condensation from dripping onto occupants and other contents within such a structure.

Another object is to enable recovery of water condensate within such a structure.

In accordance with these and other objects made apparent hereinafter, the invention concerns a structure, useable as a tent, having a cover and structural elements disposed therein to permit the cover to lay flat or stand erect. The cover has at least two layers, one of which reflects, and the other of which absorbs, ambient heat. Because of this, the structure can stand erect with either of the layers directed outwards, and the other inwards, which permits the structure to define an enclosed living space which is cooled or heated with respect to ambient depending on which layer is outwardly disposed. This also permits a user to readily deploy the structure, or fold it for easy storage. The structure can have a detachable base with a cavity fillable with fluid such as air or water, to give the structure added stability, particularly in high winds, and provide thermal inertia to insulate the enclosed space from the ground. The structure can also have a water collector that uses the Lotus Effect to collect condensate on the top of the enclosed space to prevent the condensate from dripping on an occupant, and to permit recapture and reuse of the water, a particular advantage in dry environments.

These and other objects, features, and advantages are further understood from the following detailed description of particular embodiments of the invention. It is understood, however, that the invention is capable of extended application beyond the precise details of these embodiments. Changes and modifications can be made to the embodiments that do not affect the spirit of the invention, nor exceed its scope, as expressed in the appended claims. The embodiments are described with particular reference to the accompanying drawings, wherein:

DETAILED DESCRIPTION

Figure 1:
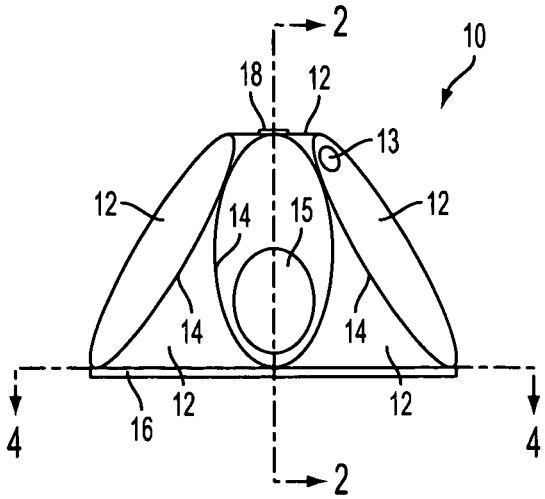
FIG. 1 is an elevational view of a pop-up shelter according to the invention.
Figure 4:
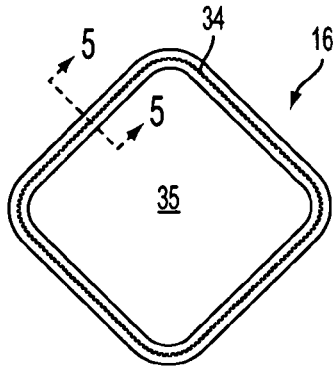
FIG. 4 is an elevational view in the direction of lines 4-4 of FIG. 1.
Figure 5:
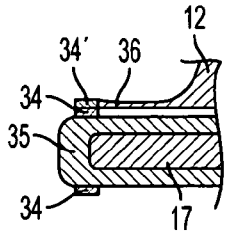
FIG. 5 is a sectional view in the direction of lines 5-5 of FIG. 4.

With reference to the drawing figures, wherein like numbers indicate like parts throughout the several views, FIG. 1 shows a structure 10 having a cover 12, preferably in the form of a fabric shell, into which is sewn, in any conventional manner about cover 12's periphery, spring loops 14. Cover 12 mounts on an optional base 16, which may be detachable (n.b. FIGS. 4 and 5). Spring loops 14 make member 10 a pop-up structure such that, by use of the outward force of spring loops 14, and by pushing or pulling structure 10 in the vicinity of handle 18, one can cause structure 10 to flatten or to deploy upright as shown in FIG. 1, and, more importantly, be reversible, that is one can deploy structure 10 with either side of cover 12 outwardly facing, and either side inwardly facing. The combination of cover 12 and spring loops 14 permit structure 10 to be folded and laid flat such that spring loops 14 can be disposed one on top of each other, and then the loops twisted, perhaps several times, in figure-eight patterns to fold structure 10 into a compact size suitable for easy storage in a relatively small space. Such pop-up structures are usable as quick-deployable tents, and structure 10 is illustrated as a tent. Structure 10 has a sealable vent opening 13, and a door flap 15 to permit entry and exit.

Figure 2:
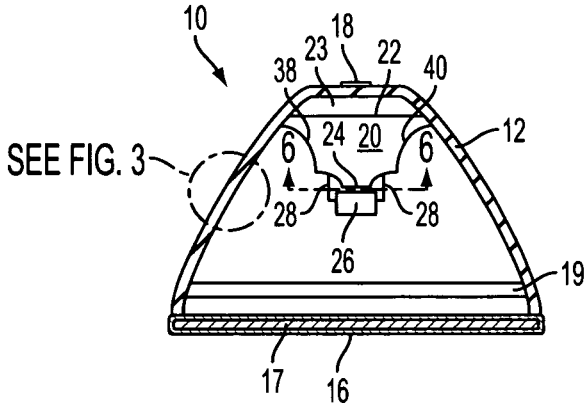
FIG. 2 is a sectional view in the direction of lines 2-2 of FIG. 1.
Figure 3:
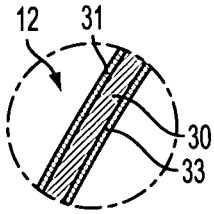
FIG. 3 is a detail sectional view of the portion of FIG. 2 encircled by lines 3-3.

With particular reference to FIGS. 2 and 3, cover 12 is seen in section, and seen to have a fabric base 30 on which are layers 31, 33, one of which is thermally reflective, and one of which is thermally absorbent. Note that layers 31, 33 can also be in direct contact with each other. In practice, if structure 10 is in a cold environment, one would deploy structure 10 with the thermally absorbent (i.e., solar absorbtive) side outward to take in heat from the environment, which, in turn will heat through to the opposite side of cover 12, thus warming the inside of structure 10. Conversely, in a hot environment, one deploys structure 10 with the thermally reflective (i.e., heat reflecting) side of cover 12 outwardly disposed to reject solar heat and thus keep the inside of structure 10 cooler than would be possible without the reflective surface.

The material constituting cover 12 may be one of a number of fabric textile materials that can be metalized with a highly ultraviolet/infrared (UV/IR) reflective coating on one side and a black matte metallic coating on the other. The black matte coating does not necessarily have to be metallic but a metallic coating is preferable for enhanced thermal transmission of absorbed radiation to the interior of structure 10 when in the heating configuration indicated above. The solar heating configuration will have the black matte surface on the outside with the reflective surface on the inside. In this configuration solar black body radiation is absorbed, heating the shell and radiating inward to heat the interior of structure 10. The reflective surface on the inside acts to collect and retain the heat reaching inside, and also acts to reflect and contain body heat radiated by the occupants of structure 10. In the solar shading/cooling configuration structure 10 is reversed and the reflective coating is placed on the outside of structure 10. In this manner 90-99% of solar radiation on hot sunny days can be reflected away from the structure allowing the interior to stay cooler than if no solar reflection were employed, thus keeping occupants cooler than in other conventional unconditioned spaces.

While many different composite fabric choices may be employed, a particularly advantageous choice for simplicity and durability is a light-weight Mylar/Kevlar/Mylar composite metal coated on one side with highly reflective aluminum or silver oxide, and coated on the other side with a black metal oxide such as Black-Chrome for solar radiation absorption.

An example of another composite material for cover 12 that can be used and metalized is APEN 18 laminate sailcloth distributed by Sailrite Enterprises, Inc., 4506 S. State Rd. 9, Churubusco, Ind. APEN-18 laminate sailcloth is a film on film laminate made of 100% EURO PEN fill and cross (45 degree) yarn with two layers of Mylar film. The EURO PEN modulus of elasticity is 2½ times higher than polyethylene (PET) (standard Dacron®) and since this modulus is a measure of a fiber's ability to resist stretching, structures made with EURO PEN fibers will stretch less and hold their designed shape longer in wind and repeated use conditions.

When structure 10 is in the heating configuration, the reflective and shiny inner fabric walls may also have a band of moisture absorbing fabric 19 running the circumference of cover 12, preferably about six inches above the bottom (FIG. 2). Moisture absorbing fabric 19 layer can be made from something as simple as pressed cotton layers alone or impregnated with silica/desiccant and will be useful in humid environments in which warm moist exhale from occupants encounters a cooler interior wall on cold nights and cloudy cold days and condenses out as water. This will help keep moisture from pooling on the tent floor and wetting occupants or contents as the beads travel down the tent wall. To help the moisture to slide down the walls of structure 10, cover 12 could be coated with a hydrophobic, and preferably superhydrophobic, coating on both sides to repel water and help water slide down the tent walls toward moisture absorbing fabric 19 more readily.

If a Mylar-Kevlar-Mylar composite-pressed-glued-sandwich fabric is used for cover 12, then the energy absorbing side of the Mylar can also be coated with a metalized aluminum-oxide substrate, which in turn is covered with: (1) a Black-Chrome coating, producing a 5% reflection and a 15% reflected radiance loss, for a total of 20% loss (80% Absorption) or (2) a Selective Absorption coating, for example the ALMECO-TiNOX coating of Almeco-TiNOX GmbH, producing a 5% reflection and a 5% reflected radiance loss, for a total of 10% loss or 90% absorption.

The energy rejecting side 31 or 33 (depending which way reversible structure 10 is opened) of cover 12 can be regular reflective Mylar film (90% reflectivity), which may be optionally coated with silicone to preserve surface finish.

Additionally, cover 12 may also be layered such that a polypropylene based non-woven perforated fabric (corresponding to base layer 30 of FIG. 3) has a similar metalization 31, 33 on the heat rejecting side and absorbing side. In this embodiment, both metalizations can advantageously be the material whose product name is Temptrol, available from Innovative Insulation, Inc., 6200 W. Pioneer Parkway, Arlington, Tex. A TemptrolT radiant barrier reflects 95% of radiant heat. The TemptrolT in FIG. 3 would be tinted black on one side and silver on the other (corresponding respectively to the heat absorbing and heat rejecting sides), with preferably an additional superhydrophobic coating on both sides to repel water. Reflectivity would be a bit less, but radiant heat rejection will be much greater, resulting in much lower temperatures inside the tent because the radiant heat from the roof will not be radiated into the tent when in the cooling orientation. Note that the superhydrophobic coating will cause the fabric to repel water to such a degree that natural rainfall will clean the outside surface of the tent as well.

Another fabric scheme having the same general structure as illustrated in FIG. 3 can be made of Flashgro Reflective Fabric. Reflective Agricultural Flashgro is a highly reflective film with a metalized polyester surface and a tough woven poly backing material. Flashgro reflects both heat and light in an even dispersed pattern on one side and can be produced with black pigment on the other side for energy absorption.

FIGS. 4 and 5 show in more detail base 16, which preferably is in the form of a flexible, impermeable, pad 35 which encloses a chamber 17 that one can fill with a fluid such as water, air, or the like to both thermally insulate the interior of structure 10 and provide a softer floor inside for sitting. On opposite sides of the periphery of pad 35 are zipper tracks 34 which mate with a corresponding zipper track (not shown) in cover 12 to permit ready attachment of base 16 to cover 12. Although zippering members 12 and 16 together permits especially fast attachment, and especially good protection against ambient conditions outside structure 10, particularly wind, any effective attachment scheme is useable, e.g. Velcro, snaps, tie-straps, or mating stake holes in cover 12 and base 16. Other effective attachment schemes can be laces, belts, buttons etc. Zipper 34' of cover 12 is preferably sewn into a flap 36 integrated into the edge (or periphery) of cover 12. The flap 36 is preferably approximately 3-6 inches in width to allow for external sand-bagging should such be desired by the user with or without the use of base 16. If one fills chamber 17 in base 16 with water and securely attaches base 16 to cover 12, the entire structure 10 will not require any external anchors to hold structure 10 in place during high winds, and a water fill in chamber 17 will help moderate the temperature inside via thermal mass. When structure 10 is erected to absorb heat from the ambient, water in base 16 will also heat, retain the heat and then radiate the heat back toward the occupants after the sun goes down or when cloud cover blocks warming radiation. When structure 10 is erected to reject heat from the ambient, water in chamber 17 will tend to be cooler than the surrounding air as it will couple with the cooler ground upon which it is sitting; thus an occupant laying on base 16 will find body heat being pulled away faster than is possible when surrounded only by hot summer air, and thus be more comfortable when air temperatures are hot.

Figure 6:
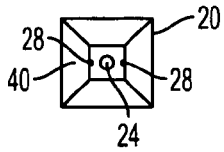
FIG. 6 is an elevational view in the direction of lines 6-6 of FIG. 2.
Figure 7:
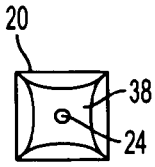
FIG. 7 is an elevational view of the same structure illustrated in FIG. 6, but of the opposite side of member 20.

FIGS. 2 and 6-7 show a moisture collector 20 attached to the interior top of structure 10, with a space 23 left therebetween. Collector 20 is of air permeable material, for example air permeable fabric formed into a closed surface to define an inner convex surface 38 and an outer concave surface 40, with large and small openings 22 and 24, respectively, at opposite ends. Such curvature is preferable because it forms a de facto funnel to catch condensate from the top of cover 12, and collect the condensate in receptacle 26, which preferably hangs by supports 28 from receptacle 20 below small opening 24. Inner surface 38 of receptacle 20 is coated with a hydrophobic, and preferably superhydrophobic, compound to make use of the Lotus Effect. As warm wet air, such as air exhaled by occupants of structure 10, rises up, vapor passes through the fabric of collector 20 into space 23 and comes in contact with the cool roof of structure 10. This vapor then condenses and begins to form water droplets on the underside of the roof. When enough vapor has condensed the droplets coalesce into larger droplets that fall from the ceiling. These droplets are now too large to pass through the treated fabric (liquid vice vapor) and, because of the superhydrophobic surface treatment, the water is repelled from inner surface 38 of collector 20. Friction with collector 20 is low (reduced droplet contact area) and the droplets shed and travel down inner side 38 of collector 20 due to gravity and exit bottom center via hole 24 where it drips into receptacle 26 for collection. In this manner, as much as 16 ounces of fresh water may be collected and recycled per day. Tubing (not shown) may also be used in place of a cup and the water routed out of the tent if reuse is not desired. The fabric of collector 20 may be attached to the roof of structure 10 in any number of ways that include but are not limited to zippers, Velcro, snaps, ties, etc. An example of such a superhydrophobic fabric/coating arrangement for collector 20 would be cotton coated with a particulate silica sol solution of co-hydrolyzed TEOS/fluorinated alkyl silane with NH3-H2O. PET (Polyethylene), vinyl, polyester and wool coated with the same mixture will also result in stable superhydrophobic surfaces with water contact angles over 170 degrees and droplet sliding angles below 7 degrees to most effectively shed water to a collection reservoir. The condensate collecting superhydrophobic water recovery system could also be manufactured using TemptrolT Radiant Curtain coated on inner surface 38 in the manner described above, with a reflective coating placed on outer surface 40 to reflect the heat of the occupants back toward them. Note that the overhead size and coverage area of opening 22 of collector 20 can be selected to collect condensate from as large a portion of structure 10's roof as desired. Obviously, a larger flatter roof would entail the need for a larger collector 20 with a larger opening 22 across the top/roof area of structure 10.

The invention has been described in what is considered to be the most practical and preferred embodiments. It is recognized, however, that obvious modifications to these embodiments may occur to those with skill in this art. Accordingly, the scope of the invention is to be discerned from reference to the appended claims, wherein:

What is claimed is:

1. A structure comprising:

a cover having a pair of sides;

a first layer disposed on one of said pair of sides, and a second layer disposed on the other of said pair of sides, said first layer being of material selected to reflect ambient heat from said first layer, said second layer being of material selected to absorb ambient heat;

a plurality of structural members disposed in said cover effective to permit said cover selectably to lay flat, or to stand erect effective to define an interior space within said cover; and a moisture collector comprising an air permeable member formed into a surface having at least one opening, said surface having an inner face and an cuter face, said at least one opening having a perimeter, said perimeter being attached to said cover in a manner to define a space between said inner face of said air permeable member and said cover;

wherein said plurality of structural members are disposed effective to selectably permit either of said first layer or said second layer to be disposed in said interior space.

2. The structure of claim 1, wherein said first layer is a metal coating.

3. The structure of claim 1, wherein said second layer is a black matte coating.

4. The structure of claim 1, wherein said cover comprises a fabric layer, and said one of said pair of sides and said other of said pair of sides are respectively the opposite sides of said fabric layer.

5. The structure of claim 1 wherein at least one of said first layer and said second layer comprises a hydrophobic coating.

6. The structure of claim 5, wherein said hydrophobic coating is a superhydrophobic coating.

7. The structure of claim 1, further comprising an attachable base, said base comprising a central chamber effective to receive thermally insulating fluid.

8. The structure of claim 7, wherein said structure further comprises a zipper disposed effective to permit attachment of said base to said cover.

9. The structure of claim 1, wherein said cover further comprises a water absorbtive material disposed to absorb condensate on said interior space.

10. The structure of claim 1, wherein said inner face comprises a hydrophobic coating or a superhydrophobic coating.

11. The structure of claim 1, wherein said inner face is generally convex, and said outer face is generally concave.

12. The structure of claim 1, wherein at least one of said first layer and said second layer is fabric.

13. The structure of claim 1, wherein both of said first layer and said second layer are fabric disposed effective to cause said cover to be a fabric shell.

14. A portable pop-up shelter comprising:

a cover having two sides and a flap disposed along the periphery of said cover;

a first layer disposed on one of said two sides, and a second layer disposed on the other of said two sides, said first layer being of material selected to reflect ambient heat from said first layer, said second layer being of material selected to absorb ambient heat;

a plurality of spring loops disposed in said cover and arranged to permit said cover to be selectably laid flat or stood erect such that said cover defines an interior space within said cover, and wherein said plurality of spring loops are also arranged to selectably permit either of said first layer or said second layer to be disposed within said interior space;

a base structure removably connected to said flap, said base structure being flexible and defining a fluid-impermeable chamber; and a moisture collector comprising an air permeable member formed into a conical surface having an inner face, large and small openings at opposing ends of said conical surface, and a perimeter edge at said large opening, whereby said perimeter edge is disposed adjacent to said cover in said interior space, said small opening is disposed at a lower elevation than said large opening, and said inner face is coated with a hydrophobic material.

15. The shelter of claim 14, wherein said first layer is a reflective metal coating.

16. The shelter of claim 14, wherein said second layer is a black matte coating.

17. The shelter of claim 14, wherein at least one of said first layer and said second layer comprises a hydrophobic coating.

18. The shelter of claim 14, further comprising means for fastening said base structure to said flap.

19. The shelter of claim 18, wherein said means for fastening is selected from the group consisting of: a zipper, Velcro, snaps, tie-straps, stake holes, laces, belts, and buttons.

* * * * *